US006030462A

United States Patent [19]

Shu et al.

[11] Patent Number: 6,030,462

[45] Date of Patent: Feb. 29, 2000

[54] SMOKING ARTICLE HAVING INCREASED AMINO ACID CONTENT

[75] Inventors: Chi-Kuen Shu, Pfafftown; Brian Michael Lawrence, Winston-Salem; Cynthia Stewart Stokes, Lexington; Milly Mee Lee Wong, Winston-Salem; Robert Henry Powell, Colfax, all of N.C.

[73] Assignee: R.J. Reynolds Tobacco Company, Winston-Salem, N.C.

[21] Appl. No.: 09/177,644

[22] Filed: Oct. 22, 1998

[51] Int. Cl.[7] ..... A24B 15/00; A24B 15/30

[52] U.S. Cl. ..... 131/274; 131/275; 544/336; 544/408

[58] Field of Search ..... 131/274, 275; 544/336, 408

[56] References Cited

U.S. PATENT DOCUMENTS

| | | | |
|---|---|---|---|
| Re. 32,095 | 3/1986 | Wu et al. . | |
| 3,478,015 | 11/1969 | Onishi et al. . | |
| 3,722,516 | 3/1973 | Suwa et al. . | |
| 3,920,026 | 11/1975 | Warfield et al. . | |
| 4,306,577 | 12/1981 | Wu et al. . | |
| 4,407,307 | 10/1983 | Gaisch et al. . | |
| 4,516,590 | 5/1985 | Teng | 131/309 |
| 4,537,204 | 8/1985 | Gaisch et al. . | |
| 5,413,122 | 5/1995 | Shu et al. . | |

OTHER PUBLICATIONS

Factors Affecting the Formation of Pyrazine Compounds in Sugar–Amine Reactions, P. E. Koehler et al., J.Agr.Food Chem., vol. 18, No. 5, 1970,pp. 895–898.

Formation of Pyrazine Compounds in Sugar–Amino Acid Model Systems, P. E. Koehler et al., J. Agr. Food Chem., vol. 17, No. 2, Mar.–Apr. 1969, pp. 393–396.

*Primary Examiner*—Stanley S. Silverman
*Assistant Examiner*—Jacqueline A Ruller

[57] ABSTRACT

A smoking article is provided having improved flavor and aroma when smoked and contains one or more smokable materials having free amino acids contained therein. The smoking article comprises a selectively enriched content of at least one amino acid selected from the group consisting of serine, threonine and analogs thereof, and is substantially free of exogenous non-sugar Maillard-functional carbonyl compounds.

20 Claims, No Drawings

SMOKING ARTICLE HAVING INCREASED AMINO ACID CONTENT

FIELD OF INVENTION

The present invention relates to smoking articles such as cigarettes, and to method for improving the flavor and aroma in smoking articles such as cigarettes.

BACKGROUND OF THE INVENTION

Popular smoking articles, such as cigarettes, have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al.; 4,756,318 to Clearman et al.; and 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouth-end piece. Such types of smoking articles provide natural tobacco flavors to the smoker thereof by heating, rather than burning, tobacco in various forms.

Flavor and aroma are important characteristics of smoking articles. To improve the flavor and aroma in smoking articles, flavorful and aromatic substances, including various natural extracts, have been included in smoking articles. For example, various processes for producing and using tobacco extracts, aroma oils and concentrates are proposed in the U.S. Patent Nos. 3,136,321 to Davis; 3,316,919 to Green; 3,424,171 to Rooker; 4,421,126 to Gellatly and 4,506,682 to Mueller and European Patent Publication No. 338,831 to Clapp et al.

In addition, it is known that tobacco flavorants can be generated by Maillard Reactions or "browning reactions" in which an amino acid reacts with a sugar at elevated temperature. Two possible pathways for Maillard Reactions have been proposed. In the first, sugar molecules react with amino acids to form Amadori or Heyns products, which then undergo a series of rearrangement to form alkylpyrazines. In the second proposed pathway, sugars initially undergo degradation and rearrangements to form smaller carbonyl compounds which then condense with nitrogen from amino acids to form alkylpyrazine compounds. See Koehler et al., *J. Agr. Food Chem.,* 18(5):895–898 (1970).

U.S. Pat. No. 3,920,026 discloses using synthetically prepared Maillard Reaction products as tobacco flavorants. These products are prepared by Maillard Reactions, i.e., by reacting one or more amino acids, preferably valine, with a sugar or a carbonyl compound that functions as a sugar substitute in the Maillard Reaction. The carbonyl compound that functions as a sugar substitute in the Maillard Reaction can be dihydroxyacetone or pyruvaldehyde.

U.S. Pat. No. 3,722,516 to Suwa describes a tobacco product having added thereto the Maillard-functional sugar substitute, dihydroxyacetone. The added dihydroxyacetone is said to react with the amino acids and ingredients analogous thereto present in the tobacco materials, thereby improving the desirable natural flavor characteristics of the tobacco materials. Dihydroxyacetone is added in an amount between 0.01 weight percent and 1.0 weight percent, based on the weight of the tobacco materials. Exogenous amino acids can also be added with dihydroxyacetone in an amount which is approximately the same as or less than the amount of dihydroxyacetone. Such amino acids include arginine, leucine, valine, lysine, asparagine, threonine, proline, phenylalanine, glycine, glutamine and ornithine.

U.S. Pat. No. 5,413,122 to Shu issued on May 9, 1995 discloses making a flavorful and aromatic composition from β-hydroxy α-amino acids by mixing the amino acids with a liquid having an aqueous character followed by heat treatment in an enclosed environment to provide an aqueous solution of volatile pyrazine flavorants. The ratio of liquid to amino acid is 4:1 to 40:1. The resulting aqueous extract containing flavorful pyrazines is then applied to smoking materials to provide flavor and aroma in the smoking articles.

Because of the volatile nature of flavorant and aroma materials, the compositions can be lost in part or entirely during manufacturing steps subsequent to application of the materials to tobacco. Also quantities of the flavorant and aroma materials can diminish during the storage of the finished smoking article and it is often necessary to increase the initial content of flavorants to compensate.

SUMMARY OF THE INVENTION

In accordance with the present invention, highly desirable flavorful and aromatic substances, and particularly flavorful and aromatic substances similar to and complementing those found in smokable materials are directly generated within a smoking article by heating one or more exogenous β-hydroxy α-amino acids during use of the smoking article. In particular, at least one β-hydroxy α-amino acid is incorporated into a smoking article to provide flavor and aroma during smoking as the amino acid(s) are heated along with the other smokable materials in the smoking article. The flavorful and aromatic substances generated upon heating of the β-hydroxy α-amino acids during use of the smoking article comprise a wide variety of alkylpyrazines, e.g., pyrazine, methylpyrazine, ethylpyrazine, dimethylpyrazine, ethyldimethylpyrazine, etc. It has been found in accord with the invention that such pyrazines are generated from β-hydroxy α-amino acids during use of the smoking article in the absence of Maillard-functional sugar substitutes such as dihydroxyacetone or other carbonyl compounds. The generation of volatile flavored and aromatic materials during smoking, allows the flavorant characteristics of the smoking article to have enhanced reliability.

Accordingly, the present invention relates to a smoking article having a content of at least one amino acid selected from the group consisting of serine and threonine and analogs thereof that is selectively enriched as compared to the endogenous content of the amino acid(s) in the smokable materials included in the smoking article. The smoking article is substantially free of exogenous Maillard-functional sugar substitute carbonyl compounds. Selective enrichment is achieved by incorporation of exogenous serine, threonine, and/or analogs thereof in the smoking article. Preferably, the smoking article contains from about 100 ppm to about $10^5$ ppm by weight, more preferably from about 500 ppm to about $10^4$ ppm, and most preferably from about 1000 ppm to about 5000 ppm of exogenous serine, threonine and/or analogs thereof.

The exogenous amino acids can be incorporated into a smoking article by various methods. For example, they can be applied as casing or top dressing ingredients to tobacco laminae and cut filler, as well as to other smokable materials. Alternatively, they can be applied to other components of the smoking article such as cigarette wrappers or cigarette filter components. When the amino acids are applied as cigarette filter additives, they are preferably included at the tobacco end portion of the filter, i.e. the end portion of the filter closest to the lighting end of the smoking article, so that the amino acids can be sufficiently heated during the smoking process to generate flavorant substances.

The smoking articles of the present invention can be provided in numerous forms and constructions including those types of smoking articles described in U.S. Pat. Nos. 4,708,151 to Shelar; 4,714,082 to Banerjee et al.; 4,756,318 to Clearman et al.; and 4,793,365 to Sensabaugh et al.; as well as European Patent Publication Nos. 212,234 and 277,519, by incorporating one or more β-hydroxy amino acids selected from the group consisting of serine, threonine, and analogs thereof, in the smoking article.

The present invention accordingly also provides methods of improving the flavor and aroma in a smoking article by treating a smoking article or component thereof to selectively enrich at least one free amino acid selected from the group consisting of serine, threonine and analogs thereof. In particular, the smoking article or at least one component thereof is treated to incorporate the exogenous free amino acids therein in substantially absence of any exogenous non-sugar carbonyl compound.

Because volatile and aromatic flavorants are generated during use of the smoking articles of the invention, the loss of flavorants and aroma materials during the manufacturing process and storage can be minimized or obviated. In turn, the present invention can provide smoking articles with improved flavor and aroma and/or smoking articles having more consistent and uniform flavorful and aromatic characters. Further, since no separate step of synthesis and/or extraction of the flavorant and aromatic materials is necessary, this invention provides a simplified and efficient method for making a flavorful and aromatic smoking article. Moreover, since the hydroxy amino acid is the only ingredient that needs to be selectively enriched in the smoking article, it is not necessary to incorporate non-sugar carbonyl compound additives such as dihydroxyacetone and pyruvaldehyde to enhance the Maillard or "browning reaction" in order to generate flavorant materials during smoking. As a result, the cost associated with such carbonyl compound can be significantly reduced.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

DETAILED DESCRIPTION OF THE INVENTION

The invention provides smoking articles, such as cigarettes, having improved flavor and aroma when smoked. The smoking article contains one or more smokable materials and has a selectively enriched content of at least one β-hydroxy α-amino acid as compared to the endogenous content of such amino acid in the smokable materials. The smoking article is substantially free of exogenous non-sugar carbonyl compounds which function as sugar substitutes in the Maillard Reaction.

Broadly speaking, any smokable material known in the art can be used for purpose of this invention. For example, tobaccos such as flue-cured tobaccos (e.g., Bright tobacco and Virginia tobacco), air-cured tobacco (e.g., Burley tobacco and Maryland tobacco), and sun-cured tobacco (e.g., Oriental tobacco) can all be used. Reconstituted tobaccos and other tobacco by-products can also be employed. One or more of the above smokable materials can be used as a blend. Optionally, synthetic tobacco supplements and semi-synthetic tobacco supplements may be added to the blend. Smokable materials also include taste modifiers such as casing and top dressing materials that often include such compositions as cocoa and licorice powders and extracts, and that can be applied to the tobacco during various stages of a cigarette manufacturing process.

As is apparent to the skilled artisan, many of the above-described smokable materials contain free amino acids. The term "free amino acids" used herein refers to amino acids that are not chemically modified and are not chemically bonded within proteins or peptides or other molecules. Generally, free amino acids exist naturally in biological materials such as plant cells. Typically, even after a series of processing steps, smoking materials such as tobacco laminae and cut fillers, as well as reconstituted tobacco and other tobacco by-products normally still contain natural free amino acids. In addition, many ingredients of casing and top dressing are biological materials and may contain natural free amino acids. The free amino acids naturally existing in the smokable materials are referred to herein as "endogenous" amino acids. As is known in the art, there are about twenty different types of free amino acids existing in biological materials. The endogenous content of each amino acid and the total endogenous content of all free amino acids in different smokable materials can be determined by various analytical methods known in the art.

The smoking article of the present invention contains a selectively enriched content of at least one amino acid selected from the group consisting of serine and threonine as compared to the endogenous content of the amino acid in the smokable materials included in the smokable article. Serine and threonine are two hydroxy amino acids existing in nature. Synthetic analogs of serine and threonine can also be included in the smoking article in lieu of or in addition to serine and/or threonine. Typically useful analogs include β-hydroxy α-amino acids represented by a formula

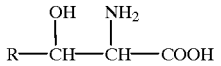

wherein R is H or an alkyl group with 1–7 carbon atoms. In preferred embodiments of the invention, the naturally occurring β-hydroxy α-amino acids are employed for selective enrichment. More preferably, serine and threonine are both selectively enriched. As shown in the example given below, selective enrichment of both serine and threonine is particularly preferred as it gives rise to particularly desirable results.

The term "selectively enriched content" is used herein to mean that the content, i.e., quantity, of the above-described amino acids, i.e., serine, threonine, and analogs thereof, in the smoking article of this invention is higher than the total endogenous content of the same amino acids in the smokable materials used in the smoking article. The term also means that the enrichment of these amino acids are "selective," i.e., the relative increase of the cumulative content by weight of these amino acids in the smoking article is greater than the relative increase in the total cumulative content by weight of the remaining free amino acids naturally present in the smoking materials. Preferably, the relative increase of the cumulative content by weight of the amino acids serine and threonine in the smoking article is at least 10% greater than the relative increase in the total cumulative content by weight of the remaining free amino acids naturally present in the smoking materials. An analog of serine and threonine is considered herein to be selectively enriched when the analog is incorporated in the smoking article at a chemically detectable amount since the endogenous content thereof in smokable materials is zero. Preferably, the content of only serine, threonine and/or analogs thereof is increased although the content of the other free amino acids can also be increased somewhat if desired. The selective enrichment can be achieved by incorporating in the smoking article "exogenous" β-hydroxy α-amino acids, i.e., by providing the above-described β-hydroxy α-amino acids in the smoking article in addition to the endogenous serine and threonine in the smokable materials used. Preferably, exogenous β-hydroxy α-amino acids are incorporated in their substantially pure forms such as solid or solution.

The total amount of all exogenous β-hydroxy α-amino acids in the smoking article of this invention can vary. Preferably, the smoking article contains from about 100 ppm to about $10^5$ ppm by weight, more preferably from about 500 ppm to about $2\times10^4$ ppm, and most preferably from about 1000 ppm to about $10^4$ ppm of the exogenous β-hydroxy α-amino acids. As used herein, "ppm" exogenous β-hydroxy α-amino acid indicates that the total content of all exogenous β-hydroxy α-amino acids in a smoking article as parts per million parts by weight based on the total weight of smokable materials in the smoking article.

While the β-hydroxy α-amino acids content in the smoking article is selectively enriched by, e.g., incorporation of exogenous β-hydroxy α-amino acids, the smoking article is substantially free of exogenous non-sugar Maillard-functional sugar substitute carbonyl compounds. The term "non-sugar Maillard-functional carbonyl compounds" is used herein to refer to the carbonyl compounds which are not sugars and are known to react with amino acids during Maillard Reactions. In particular, such non-sugar Maillard-functional carbonyl compounds are hydroxyketones such as dihydroxyacetone and dicarbonyl compounds such as pyruvaldehyde. The phrase "substantially free of exogenous non-sugar Maillard-functional carbonyl compounds" is intended to mean that non-sugar carbonyl compounds are not incorporated into the smoking article except for those inherent in the smoking materials of the smoking article and those generated during smoking.

When smoking articles of the invention are used, i.e., smoked, the heat from, e.g., combustion of the tobacco rod, causes the β-hydroxy α-amino acids incorporated in the smoking article to undergo thermal reactions to yield compositions or products which exhibit an aroma which can be characterized as pleasant, clean, sweet, floral, woody, musk-like and fruity. The aroma provided is such that the characteristic sidestream cigarette smoke aroma is masked or overridden by those components. As such the β-hydroxy α-amino acids provide for a reduction in the negative attributes associated with the aroma of sidestream smoke.

The burning system of the cigarette has been well established in the art. During puffing, air is drawn into the cigarette through the coal on the end of the cigarette and mainstream smoke is formed. The oxygen in the inspired air causes incomplete combustion of the coal yielding tarry vapor, water, and gases at about 900° C. peak temperature. In the interval between puffs, smoldering occurs and air is drawn upward around the coal which forms sidestream smoke. The mainstream smoke cools down as it travel upward within the cigarette rod. Further, during puffing, the heat of the coal and the smoke cause pyrolysis of the tobacco immediately behind the combustion zone. As a result of these processes, different locations within the cigarette rod can have different temperatures which could range from about 20° C. to as high as 900 to 1000° C. Although not wishing to be bound to any theory, it is believed that during the smoking process, the β-hydroxy α-amino acids in the smoking article are heated and undergo a series of thermal reactions to form flavorful pyrazines often found in tobacco-derived flavorful and aromatic compounds. However, it is believed that Strecker degradation or the Maillard reaction is not involved in these thermal reactions. Exemplary pyrazines include pyrazine, methyl pyrazine, ethyl pyrazine, 2,5-dimethyl pyrazine, 2,6-dimethyl pyrazine, 2-ethyl-5 methyl pyrazine, 2-ethyl-6-methyl pyrazine, trimethyl pyrazine, tetramethyl pyrazine, dimethyl ethyl pyrazines, diethyl methyl pyrazines, diethyl dimethyl pyrazines, 6,7-dihydro-5-methyl-5H-cyclopentapyrazine and the like. Because flavorful and aromatic pyrazines can be generated from the hydroxy amino acids alone as the present inventor has discovered, sugars and non-sugar carbonyl compounds which are required in Maillard Reactions or "browning reactions" are not necessary in the present invention for purpose of producing the desired flavor and aroma. Consequently, unlike the smoking product disclosed in U.S. Pat. No. 3,722,516, exogeneous non-sugar compounds such as dihydroxyacetone need not be added or selectively enriched in the smoking article of the present invention.

The β-hydroxy α-amino acids can provide the above flavorful and aromatic compounds when heated to a temperature of from about 100° C. to about 1000° C., preferably to about 200° C. or higher, and most preferably to a temperature of about 250° C. or higher. Therefore, such amino acids can be incorporated to any part of the smoking article so long as they can be heated during the smoking process to a temperature within the above ranges. In a smoking article such as a cigarette, because the combustion zone moves toward the smoker during the entire smoking process, the above temperature may be reached at almost any location in the cigarette rod. Therefore, the amino acids can be located anywhere within the cigarette rod. However, it is preferred that the amino acids are not exposed to such a high temperature for a sufficiently long period of time so as to provide a reaction material which exhibits a burnt, tarry, overly bitter or highly metallic flavor. Therefore, it is preferred that the amino acids are located at least about 5 mm, more preferably at least about 10 mm away from the initial combustion zone, and most preferably in the upper half of the cigarette rod.

The β-hydroxy α-amino acids can also be incorporated into smoking articles by various methods. For example, in cigarette manufacturing processes, the β-hydroxy α-amino acids can be applied as a casing material or as an ingredient of casing materials. As is well known in the art, casing materials are used as additives to enhance the flavors in smokable materials. In cigarette manufacturing processes, casing materials are added to tobacco leaf blends before cutting. Casing materials are usually applied as suspensions or solutions. Exemplary casing ingredients that are commonly used in the art include, e.g., sugar, humectants such as glycerine or a higher glycol, licorice, cocoa, etc. The β-hydroxy α-amino acids used in the present invention can be mixed with any of the ingredients suspended or dissolved in the casing. The casing can be applied to the leaf blend by either spraying or as a dip casing, or by other processes known in the art to allow the β-hydroxy α-amino acid(s) to be coated onto or absorbed by the blend. Alternatively, pure β-hydroxy α-amino acids solution can also be applied to tobacco leaf blends in the same manner. Further, β-hydroxy α-amino acid(s) particles or powder may also be applied directly onto the tobacco leaf blend.

In advantageous embodiments of the invention, sugars added via conventional casing or like treatments can be reduced or eliminated. Advantageously, the total exogenous or added sugar content of the smoking article is less than the exogenous β-hydroxy α-amino acid content thereof. In preferred aspects of this embodiment, the smoking article is substantially free of exogenous, i.e., added sugar.

The β-hydroxy α-amino acid(s) can be incorporated into smoking materials as a top dressing ingredient. As is well known in the art, top dressing is added after the tobacco blend is cut into shreds or "cut filler", to supply aroma or pleasing flavor. Top dressing is usually applied as a spray solution containing highly aromatic, perfume-like substances and a material such as a glycol to retard the evaporation of the flavorant in the cigarette or cigarette package. The β-hydroxy α-amino acid(s) can thus be dissolved in the top dressing spray solution which is then sprayed onto the tobacco shreds. Pure β-hydroxy α-amino acid(s) solution can also be applied to the tobacco cut filler in the same manner. Alternatively, β-hydroxy α-amino acid(s) particles or powder may be applied directly onto tobacco cut filler. Amino acid powder, particles or solution can also be incorporated into smoking articles concurrently as the tobacco cut filler is formed into cigarette rods.

In like manners, the β-hydroxy α-amino acid(s), either in solution or particles or powder, can also be applied onto cigarette wrapping paper, preferably on the inside surface, during the cigarette manufacturing process. Application to specific location of the wrapping paper can easily be done so as to adjust the heating temperature the amino acids are exposed to within the cigarette made with this wrapping paper.

Similarly, the β-hydroxy α-amino acids can be incorporated into, or applied onto reconstituted tobacco materials including cast reconstituted tobacco materials, and reconstituted tobacco materials formed by paper making processes.

Smoking articles can further include a filter element such as positioned adjacent to one end of rod such that the filter element is axially aligned with the rod in an end-to-end relation. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material.

The β-hydroxy α-amino acids can be incorporated into the cigarette filter, either in the filter plug or plug wrap, or tipping paper. For example, the exogenous amino acids can be incorporated into low-density polyethylene which is formed into strands, and then incorporated into cigarette filters as described in U.S. Pat. Nos. 4,281,671 to Bynre et al. and 4,826,905 to Green, Jr. et al. The amino acids can also be incorporated into the filter material by soaking the filter material in a β-hydroxy α-amino acid solution or by spraying the solution onto the filter material, or by spreading solid β-hydroxy α-amino acid during the process of making the filter. The filter material can be a conventional cigarette filter material such as cellulose acetate, polypropylene, or the like, and the filter element can have a fibrous character, a molded shape, or other such configuration. As the amino acids must be heated at a sufficiently high temperature, they are preferably incorporated in the bottom portion of the filter which abuts the cigarette rod.

The β-hydroxy α-amino acids can also be used in a similar manner in many types of smoking articles other than the currently widely available cigarette constructions. For example, tobacco cut filler having the amino acids applied therein may be combined with aerosol forming materials, and employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al., as well as European Patent Publication Nos. 212,234 and 277,519, the disclosures of which are incorporated herein by reference. In addition, the tobacco cut filler containing exogenous β-hydroxy α-amino acid can be incorporated into those smoking articles described in U.S. Pat. No. 5,074,321 and European Patent Publication No. 280,990.

The following example is provided in order to further illustrate preferred aspects of the invention but should not be construed as limiting the scope thereof. Unless otherwise noted, all parts and percentages are by weight.

EXAMPLE 1

300 mg of threonine and 36 μl of water are mixed to simulate a moisture level at 12% as in cigarettes. The mixture was heated in an enclosed vessel at 300° C. for 7 minutes (including the heat transfer period for the vessel). After heating, the vessel was cooled with cold water, and the material obtained was extracted by methylene chloride. The methylene chloride extract was concentrated and analyzed by GC/MS on a DB-WAX fused silica column (60 m×0.32 mm, 0.15μ film thickness) with a mass selective detector (EI; 70 eV). The oven temperature was programmed from 50° C. to 200° C. at 6° C./min.

In the same manner, 300 mg of serine as well as a mixture of 150 mg of serine and 150 mg of threonine were heated and analyzed. The major products identified in the analysis are shown in Table 1. As used herein, "ppm" means part per million parts of the amino acid subjected to heat treatment.

Amino acid leucine and alanine were heated in the same conditions respectively in separate experiments. It was found that pyrolysis of leucine or alanine did not produce any detectable amount of pyrazine products.

TABLE I

| | 300° C./7 min | | |
|---|---|---|---|
| Pyrazine identified (ppm) | From Ser | From Thr | From Ser/Thr |
| Pyrazine | 1477 | | 354 |
| methyl- | 245 | | 880 |
| 2,5-dimethyl- | | 1100 | 898 |
| 2,6-dimethyl- | | 390 | 501 |
| ethyl- | 1025 | | 348 |
| 2,3-dimethyl- | | | |
| 2-ethyl-6-methyl- | 131 | | 1077 |
| 2-ethyl-5-methyl- | | | 281 |
| trimethyl- | | 271 | 705 |
| 2,6-diethyl- | 391 | | 247 |
| 2-ethyl-3,6-dimethyl- | | 632 | 2291 |

TABLE I-continued

| Pyrazine identified (ppm) | 300° C./7 min | | |
|---|---|---|---|
| | From Ser | From Thr | From Ser/Thr |
| 2-ethyl-3,5-dimethyl- | — | 83 | 458 |
| Total | 3269 | 2476 | 8040 |

EXAMPLE 2

Cigarettes were prepared having lengths of 84 mm and circumferences of 24.75 mm. Each cigarette included a tobacco rod having a length of 653 mm and a filter element having a length of 21 mm. The tobacco rod included a charge of tobacco cut filler contained in a circumscribing cigarette paper wrap. The tobacco cut filler was an "American blend," and the paper wrap is available as Reference No. 856 from Kimberly-Clark Corp. The filter element was manufactured using conventional cigarette filter making technology from plasticized cellulose acetate tow circumscribed by paper plug wrap.

A mixture of serine and threonine at 1 to 1 weight ratio was prepared by dissolving both solids in water. About 1,000 ppm of this amino acid mixture was applied to the cut filler of the tobacco rods as a top dressing component of the paper wrap of the tobacco rod. The cigarettes so treated were air-dried. Upon smoking the cigarettes, the resulting cigarette mainstream smoke exhibited a flavor which was more pleasant relative to mainstream smoke of a similar cigarette not having the amino acids serine and threonine therein.

That which is claimed is:

1. A smoking article comprising one or more smokable materials having free amino acids contained therein, said smoking article being substantially free of exogenous non-sugar Maillard-functional carbonyl compounds and comprising at least one exogenous amino acid selected from the group consisting of serine, threonine, and analogs thereof, and said smoking article having a selectively enriched content of said at least one amino acid selected from the group consisting of serine, threonine, and analogs thereof.

2. The smoking article of claim 1, wherein said smoking article comprises a selectively enriched content of serine.

3. The smoking article of claim 1, wherein said smoking article comprises a selectively enriched content of threonine.

4. The smoking article of claim 1, wherein said smoking article comprises a selectively enriched content of serine and threonine.

5. The smoking article of claim 1, wherein said smoking article comprises analogs of serine and threonine.

6. The smoking article of claim 1, wherein said smoking article comprises a selectively enriched total content of from about 500 ppm to about $10^4$ ppm of serine and threonine.

7. The smoking article of claim 1, wherein said smoking article is a cigarette.

8. The smoking article of claim 1, wherein said smoking article is substantially free of exogenous sugar.

9. A smoking article comprising one or more smokable materials having free amino acids contained therein, said smoking article being substantially free of exogenous non-sugar carbonyl compound and comprising a selectively enriched content of at least one amino acid selected from the group consisting of serine, threonine and analogs thereof, said content being in the range of from about 100 ppm to about $10^5$ ppm.

10. The smoking article of claim 9, wherein said content is from about 500 ppm to about $2\times10^4$ ppm.

11. The smoking article of claim 9, wherein said content is from about 1000 ppm to about 5000 ppm.

12. A method for improving the flavor and aroma properties in a smoking article comprising selectively enriching at least one free amino acid selected from the group consisting of serine, threonine, and analogs thereof, in at least one component of said smoking article, said smoking article being substantially free of exogenous non-sugar Maillard-functional carbonyl compound.

13. The method of claim 12, wherein said free amino acid is serine.

14. The method of claim 12, wherein said free amino acid is threonine.

15. The method of claim 12, wherein both threonine and serine are enriched in said smoking article.

16. The method of claim 12, wherein the content of said at least one amino acid in said smoking article is from about 100 ppm to about $10^5$ ppm.

17. The method of claim 12, wherein the content of said at least one amino acid in said smoking article is from about 500 ppm to about $10^4$ ppm.

18. The method of claim 12, wherein said step of selectively enriching said at least one amino acid comprises applying said at least one amino acid as a casing material.

19. The method of claim 12, wherein said step of selectively enriching said at least one amino acid comprises applying said at least one amino acid as a top dressing ingredient.

20. The method of claim 12, wherein said smoking article is substantially free of exogeneous sugar.

* * * * *